US005628679A

United States Patent [19]

Shiga

[11] Patent Number: 5,628,679

[45] Date of Patent: May 13, 1997

[54] HOLDER FOR AN ABRADING DISK TOOL

[75] Inventor: Chujiro Shiga, Sagamihara, Japan

[73] Assignee: Minnesota Mining and Manufacturing Company, St. Paul, Minn.

[21] Appl. No.: 495,342

[22] Filed: Jun. 27, 1995

[51] Int. Cl.[6] ..... B24D 17/00; B24D 9/04

[52] U.S. Cl. ..... 451/508; 451/514; 451/533

[58] Field of Search ..... 15/230, 230.19; 242/118.6, 118.61; 451/490, 496, 497, 498, 508, 514, 533, 543, 544

[56] References Cited

U.S. PATENT DOCUMENTS

| | | | |
|---|---|---|---|
| 260,336 | 6/1882 | Thayer . | |
| 2,355,667 | 8/1944 | Melton et al. | 51/193 |
| 2,403,813 | 7/1946 | Manderscheid . | |
| 3,212,819 | 10/1965 | Chruchill | 451/533 X |
| 3,287,863 | 11/1966 | Field . | |
| 3,347,219 | 10/1967 | Wellborn | 451/544 X |
| 3,643,284 | 2/1972 | Patterson | 15/230.19 |
| 3,667,169 | 6/1972 | Mackay, Jr. . | |
| 4,177,611 | 12/1979 | Carr-Rollett | 451/508 |
| 4,504,999 | 3/1985 | Pedrotte | 15/230.1 |

FOREIGN PATENT DOCUMENTS

| | | | |
|---|---|---|---|
| 2076741 | 10/1971 | France | B24D 13/00 |
| 4326793C1 | 9/1994 | Germany | A46B 13/02 |
| WO92/06821 | 4/1992 | WIPO | B24D 13/10 |

*Primary Examiner*—Timothy V. Eley

*Attorney, Agent, or Firm*—Gary L. Griswold; Walter N. Kirn; William L. Huebsch

[57] ABSTRACT

An improved abrading disk tool for holding a multi-layer brush of stacked non-woven fibrous webs to be mounted on a rotation driving spindle in use, which tool can be easily assembled without using any adhesive, but using tool members which, preferably, may be injection-molded with a plastic material. The members of the tool include a pair of compatible holder halves (1), each having a base (10) and a central hollow pole (20) and/or a plurality of eccentrically arranged hollow and/or solid poles (30) axially extending from the base. The holder halves have corresponding configurations, preferably geometrically dimensionally equal ones. Each pole has snap detent means comprising a male element (40) and/or a female element (50), provided at its free end, which element is engageable with that of a corresponding pole in the counterpart holder half to axially inter-lock both the holder halves.

16 Claims, 6 Drawing Sheets

HOLDER FOR AN ABRADING DISK TOOL

TECHNICAL FIELD

The present invention relates to an abrading disk tool with an abrading brush of compacted non-woven fibrous webs, particularly a tool holder for the compacted multi-layer web brush of polyamide resin fibers or the like. The abrading tool is mounted on a rotation driving shaft or spindle for rotating with the spindle. An abrading operation by the abrading tool includes grinding, polishing, sanding, buffing and like operations.

BACKGROUND OF THE INVENTION

Such an abrading tool can be produced according to a first conventional method wherein non-woven fibrous webs die-cut to form so called "disks" having a central hole are stacked one on another with a rotation driving shaft with a threaded free end disposed in the disk holes and then are compacted. The compacted disk webs are then held by two holding disk plates or bases having bores with a pair of key grooves through which the shaft extends with the shaft free end screwed into a nut. This method is disadvantageous in that the rotation driving shafts per se are required to produce such compacted multi-layer disk brushes in a first factory, and thus they are obliged to be transported from and returned to a second factory or user where the disk brushes are used with the driving shafts for abrading purposes. Further, for the second user, it is troublesome to disassemble the spindle from an abrading apparatus for sending the spindle to the first factory producing abrading brushes.

To avoid such transportation of the driving shafts, there are second and third known methods. According to the second method, a hollow cylindrical core of a resin, preferably, a paper sheet impregnated with phenol resin, is disposed in and tight-fitted with the central holes of the stacked abrasive webs with its opposite free end portions extending outwards of the stacked webs, and is fixed to the webs with an adhesive added between the core and the webs in the web holes. Each free end portion of the core is notched from the end edge thereof to form a pair of key grooves. During the above operation, a pair of plastic ring plates, so called "end plates" of, for example, PVC are mounted on the opposite end portions of the core to abut against the piled webs with the core end portions being inserted in the ring plates, respectively. Then, similarly, a cylindrical stopper ring of stainless steel notched from the end edge thereof to form a pair of key grooves for the below-mentioned flange is mounted on each core end portion so that its key grooves are aligned with the key grooves of the core and it abuts against the ring plate, and is fixed to the core with the adhesive. A pair of flanges serve as tools for mounting the grinding tool completed by the above operations on the spindle. Each flange has a cylindrical extension with a pair of key projections or reverse keyways for both the core and stopper ring and a central through-hole with a pair of key grooves therein for the spindle. The flanges are disposed in the core from the opposite core end portions to abut against both the core and stopper ring with the key projections being engaged with the aligned key grooves of both the core and stopper rings.

It is very difficult and troublesome to apply the adhesive to both the hole surfaces of the stacked webs and the core outer surface, while the stacked webs are provisionally compacted by an appropriate means. Particularly speaking, while the stacked webs are provisionally compacted between the opposite bases with their holes in combination forming a vertically extending hole, the adhesive is poured into the vertical hole from an upper end thereof and concurrently the hollow core with a bullet-like closure or plug temporarily mounted on the upper core end is disposed into the vertical hole from a lower end thereof. These concurrent operations are very troublesome and are likely to cause the stacked webs and the environment around the webs to become dirty with a part of the adhesive discharged from the vertical web hole. According to this conventional method, the provisional compacting operation is obliged to take a long time until the adhesive is cured. Further, the above assembling operation with the separate parts, i.e., the core, the paired ring plates and the paired stopper rings, using the adhesive is also troublesome.

The above first and second methods require thin backing plates of a disk form, each having a central hole coinciding with the web hole. The backing plates are of a rigid paper and have the same diameter as that of the base smaller than that of web (see "150" in FIG. 4). The stacked webs include the backing paper plates, each interposed between neighboring groups of the webs, each group consisting of several webs. The interposed backing plates are adapted to prevent the stacked and compacted webs held by the opposite bases from moving tangentially or rotating relative to each other, by friction exerted between each backing plate and neighboring webs, while the abrading disk tool with the compacted webs is in operation or works with a product to be ground. The backing plates also keep the piled webs compacted together by the same friction over at least radially inner web portions backed by the backing disk plates. This is effective, even if the webs are partially pressed by the product so that the webs would be, otherwise, separated into two groups over the entire radial portions.

The third known method of producing an abrading disk tool with the compacted abrasive webs using an adhesive, was invented by the inventor of the present application. This is a method improved from the above second method using the adhesive in that the troublesome operation for disposing the hollow core into the stacked webs is avoided. This is because there is no core required, and the opposite bases for holding the compacted webs therebetween are no longer required. Further, the before-mentioned backing plates are no longer required. Of course, such backing plates may be interposed in the stacked webs.

Abrading disk tools produced by this improved method are now becoming more widely used. According to the improved method, abrasive non-woven fibrous webs are die-cut, each to have a disk form with a central hole having key grooves for a key projection of a rotation driving spindle or shaft and a plurality of peripheral holes arranged around the central hole. The die-cut disk webs are stacked one on another, and are covered by an upper covering member having holes temporarily applied at a top side of a combination (i.e., brush) of the stacked webs having a vertical axis with the member holes opening to the central and peripheral holes of the web combination. Further, the web combination is covered by a lower covering member temporarily applied to close the central and peripheral holes of the web combination at the bottom side thereof.

The covered web combination is provisionally compacted, and at the compacted state, an adhesive is poured into the holes of the web combination from the top side thereof to fill the holes with the adhesive. The covered compacted web combination with the adhesive is kept for a sufficient time, as it is to have portions of the web combination around the central and peripheral holes impregnated with the adhesive, and then the surplus or non-impregnated parts of the adhesive in the central and peripheral holes are discharged out of the web combination. The covered web combination is kept as it is, while it is compacted, for another time enough to have the impregnated adhesive parts cured completely.

As a result, when the upper and lower covering members are removed, an abrading disk tool with no core and backing plates is completed. Of course, such backing plates may be interposed as in the above second method. The adhesive impregnated portions of the web combination around the respective peripheral holes are rigid due to the cured adhesive, as well as the adhesive impregnated portion around the central hole. Therefore, the rigid portions prevent the stacked webs from moving relative to each other and keep the stacked webs compacted together over non-impregnated web portions radially inwards of the impregnated web portions around the peripheral holes.

The adhesive impregnated web portions around the central hole for the spindle to be held at the key grooves and those around the peripheral holes which may be used for at least a pair of auxiliary shafts, all work effectively as means for holding the stacked webs in a compacted state.

The third method as described above is advantageous over the first and second methods in various aspects, but still encounters a difficult problem wherein use of the adhesive leads to troublesome operations, although the difficulty is reduced relative to that in the second method, and still requires means for provisionally compacting the stacked webs and a long production time mainly taken for curing the adhesive, even if an abrading disk tool with stacked webs small in size and/or the entire thickness is produced. This leads to a low productivity of the tool.

Further, there still remains substantially the same inherent problem as that of the second method; that is, the adhesive handling operation is apt to cause the stacked webs and the environment around the same to be polluted with the adhesive during production of the tool. Such adhesives, particularly solvent-based adhesives are not environmentally favorable, particularly in Europe, and even in this regard it is preferable to avoid use of adhesives in production of abrading brush tools, if possible.

SUMMARY OF THE INVENTION

One aspect of the present invention presents a holder for an abrading disk tool adapted to hold an abrading multi-layer disk brush therebetween under pressure. The holder comprises first and second compatible holder halves, wherein each of the first and second holder halves comprises a base having a central axis and at least one pole axially extending from the base. Each of the poles includes a snap detent means, the detent means in the first holder half being adapted to engage in a male-female relation with a corresponding detent means in the second holder half. The detent means axially inter-lock the first and second holder halves together with the bases facing one another, with the poles extending therebetween.

Another aspect of the present invention presents a holder half adapted to be combined with a counterpart holder half to thereby form a holder for an abrading disk tool, the tool is for holding an abrading multi-layer disk brush compatible with the holder halves therebetween under pressure. The holder halves are arranged to coaxially face each other. The holder half comprises a base having a central axis and a center hole, and a center hollow pole opening to the central hole and extending coaxially from the base. The center hollow pole is adapted to have the holder mounted on a rotation driving shaft which is adapted to coaxially extend through the central hole and the central hollow pole. The central hollow pole has a circumferential wall provided at a free wall end thereof with male and female snap fit elements adapted for inter-locking the holder half to a counterpart holder half. The male and female snap fit elements are arranged diametrically opposite to each other along a first center line passing through the base axis and are adapted to engage with the female and male snap fit elements of a corresponding central pole in a counterpart holder half.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1C:
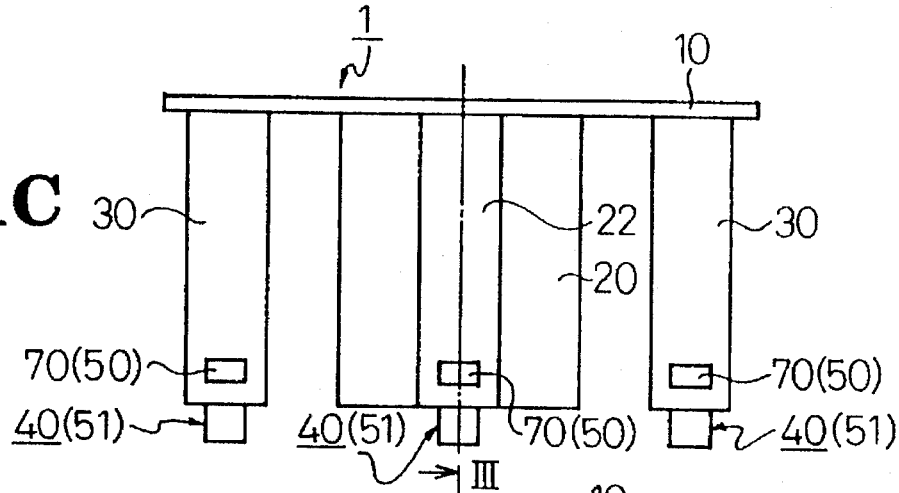
FIG. 1(A) is an elevational view of a holder half according to a first embodiment of the present invention.
FIG. 1(B) is a plan view of the holder half of FIG. 1(A) taken along plane 1(B)—1(B)
FIG. 1 (C) is an elevational view of the holder half of FIG. 1(B) taken along plane 1(C)—1(C)

The present invention is contemplated to provide a holder consisting of a pair of holder halves for enabling the stacked brush webs to be compacted and held in a compacted manner between the holder halves by a simple operation without using any adhesive or a rotation driving shaft or spindle. The holder with the compacted brush forms an abrading tool on which a rotation driving shaft or spindle can be mounted when the tool is used for abrading. Particularly, the simple operation merely requires one action of pushing one of the holder halves toward the other holder half on an operation table against the stacked webs therebetween so as to have the webs compacted.

The present invention is further contemplated to provide less expensive holder halves which are disposable and easily produced with a reduced cost. In addition, the holder halves in one of the best contemplated modes are allowed to be geometrically and dimensionally equivalent to each other. Particularly, the equivalent holder halves are contemplated to be produced by an injection molding with a plastic material.

According to the present invention, there is provided a holder comprising first and second compatible holder halves adapted to hold an abrading multi-layer disk brush compatible with the holder halves coaxially facing each other therebetween under pressure. Each holder half comprises a base having a central axis and at least one pole, each axially extending from the base and provided with snap detent means, preferably at a free end thereof. The detent means of each pole in the first holder half is adapted to engage in a male-female relation with that of a counterpart pole in the second holder half. Preferably, each holder half may comprise a central hollow pole coaxial with the base axis with the detent means. The base of each holder half has a central hole open to the central hollow pole. The holder is adapted to receive a rotation driving spindle from one of the bases into the central hollow poles to secure it to the same.

The "compatible" brush means that the disk brush is composed of a plurality of stacked abrasive webs, each having a common hole through which a corresponding pole of each of the first and second holder halves is allowed to extend. Preferably, the web hole is designed to be smaller in size than the pole, enough to resist against the pole being inserted to a desired extent.

So long as each holder half has only the central pole, the central pole must be provided with at least one key projection or a reverse keyway for preventing the brush or stacked webs from rotating relative to the central pole. Preferably, the key projection defines a key groove at the inner surface of the pole wall adapted to receive a corresponding key projection of the rotation driving spindle.

Preferably, in addition to the central pole as a main pole each holder half comprises one or more of auxiliary hollow or solid poles with the snap detent means, spaced radially from the central or main hollow pole.

The snap detent means of the present invention are based on a principle the same as or similar to that of a well-known "hook and eye" commonly used in garments. In this regard, the snap detent means of each pole in the first holder half may consist of a male snap fit element, while that of a counterpart pole in the second holder half consists of a compatible female snap fit element. In this case, the auxiliary pole may be of a solid form.

However, to attain a well-balanced engagement between a pole of the first holder half and a counterpart pole of the second one, it is preferable that each pole is of a hollow form and the snap detent means of each pole consists of male snap fit element and female snap fit element arranged diametrically opposite to each other at the free end of the circumferential pole wall. The male and female snap fit elements of each pole in the first holder half are adapted to engage with the female and male snap fit element of a counterpart pole in the second holder half, when the two opposite poles are relatively moved axially toward each other. In this case, preferable poles are of a hollow form.

Preferably, the first and second holder halves have corresponding configuration with the poles, all having the same axial length from respective bases. Most preferably, the corresponding configuration is a geometrically and dimensionally equivalent configuration. This brings about the interchangeability of the first and second holder halves to be combined, and thus the possibility of producing both the holder halves by a single mold.

The first and second holder halves have positioning means for enabling the holder halves to be matched in a correct angular position, and preferably the base of each holder half has a pair of positioning holes spaced radially from the center hole. The paired poles may be used to allow a pair of auxiliary shafts to extend therethrough and through a pair of corresponding holes in the counterpart holder half. The auxiliary shafts are adapted to be secured to the spindle as a main shaft at their opposite end portions with the intermediate auxiliary shaft portions extending through the bases of the holder halves, so that the stacked webs are prevented from moving relative to the spindle. The other positioning element may be an operation table with a pair of upright bars to be inserted into the holes of the bases when the holder halves are combined on the table.

According to the present invention, the holder may further comprise a longitudinal spacer pole provided at opposite ends thereof with first and second snap detent means for each pole of the first holder half and a counterpart pole of the second holder half. The first and second detent means are adapted to engage in a male-female relation with the detent means of the associated poles in the first and second holder halves, respectively. The longitudinal spacer poles are used for adjusting an axial space gap between the bases of the first and second holder halves when the holder is completed, so that the bases compact the stacked abrasive webs to a desired extent.

With respect to the male and female snap fit elements arranged diametrically opposite to each other at the free end of each hollow pole, the male element comprises a locking projection of a cantilever having a body axially outwardly extending from the free wall end and a chamfered head hooked radially outwardly, and the female element comprises a locking window formed in the circumferential pole wall at the free wall end. The locking projection is resiliently bendable with the hooked head being chamfered so as to allow the hooked head to enter under pressure into the associated hollow pole of the counterpart holder half from the free wall end thereof and then engage with the counterpart locking window thereof.

Preferably, the central hollow pole may have a pair of key radial projections axially extending and arranged diametrically opposite to each other, defining key grooves, axially extending at the inner surface of the pole wall for a pair of key projections of the spindle. In this case, preferably, the key projections of the central hollow pole may be provided with the male and female snap fit elements, particularly to the locking projection and the locking window.

With the above-featured holder, the paired holder halves are at least axially interlocked at the free ends of their corresponding poles when the associated male and female snap fit elements are engaged with each other. In a case where the center hollow pole involves the above-mentioned locking window to be engageable with the associated hooked head, the paired holder halves are also tangentially interlocked with each other, that is, prevented from rotating from each other. However, a resistance against the relative rotation is not so large. Each pair of engageable auxiliary poles of the holder halves considerably enhances this rotation resistance. Further, the rotation resistance is enhanced by a friction generated between the opposite bases and the stacked webs compacted therebetween with the key projections of the center pole being engaged with the key grooves of the stacked webs.

The detent element engagement is effected by vertically downwardly pushing the first or second holder half toward the other holder half put on an operation table at the base thereof with a desired number of non-woven fibrous webs being stacked on the base with the poles extending into the associated holes of webs, while both the holder halves are faced and positioned precisely relative to each other as desired by the positioning means.

Each base of the first and second holder halves has a diameter smaller than that of the stacked webs by a predetermined length. This means that, although the stacked webs are compacted by the opposite bases, they are compact-free at an outer portion projected radially from the peripheries of the bases by the above diameter gap, and thus the layers of the stacked web may separate from each other at the outer, uncompacted portion. However, a centrifugal force generated during rotation of the brush of the stacked webs with the spindle causes the uncompacted outer portion of the stacked webs to be tensioned so that each layer of the outer web portion is oriented radially outwardly. The tensioned webs resist against the separation of the webs. The above described difference in the diameters of the bases and the webs is necessary to prevent the bases from obstructing abrading by the web, and corresponds to the amount of the stacked webs or brush to used for abrading. After prolonged use, the non-woven fibrous webs may be precompacted to cause the outer portion of the webs to maintain itself compacted to some extent after release from the holder halves.

So long as each holder half has only a central pole, it is preferable to interpose backing disk plates in the stacked webs to exhibit the same effects as those in the holders according to the before-mentioned first and second methods.

Usually, the individual disk web with a desired diameter is formed by die-cutting a non-woven web made of polyamide fibers or the like with a web thickness of 7 mm. The stacked disc webs are composed of 50 individual disk webs and compacted in the holder so as to have the entire thickness of 150 mm with a compact ratio of 230%. Such webs are available in a variety of sizes, styles, and abrasiveness from Minnesota Mining and Manufacturing Company, St. Paul, Minn., USA, under the trade name of "Scotch Brite."

If for a particular holder and web combination, the bases of the interlocked holder halves do not sufficiently compacted the web, a spacer may be employed. The spacer can comprise, for example, a combination of such backing disk plates as those described before, and may be stacked one on another for sufficient thickness. Or, a single disk plate with a necessary thickness can be interposed between one of the bases and the stacked webs. Alternatively, a number of backing plates may be interposed between neighboring groups of the stacked webs. However, it should be noted that the separately interposed backing plates are contemplated in combination mainly to work as a spacer means. Accordingly to the present invention, so long as each holder half has a central pole as a main pole and at least one auxiliary pole, such backing plates as those for exerting the friction against neighboring groups of the webs involved in the before-mentioned first and second method is no longer necessary as in the before-mentioned third method. This is because the opposite bases and the interlocked auxiliary poles extending therefrom through the associated peripheral holes of the stacked webs, in combination, work to prevent individual webs from moving relative to each other and keep the webs compacted together over the inner portion of the stacked webs overlapped by the bases. This is so even if a workpiece to be abraded is radially pushed between webs.

In turn, if the axial space gap is so large that the opposite bases cannot compact the stacked webs therebetween under a desired pressure, the longitudinal spacer poles having a necessary length with the snap fit elements provided at the opposite free ends thereof may be used to interconnect corresponding poles of the opposite holder halves via the spacer pole therebetween to thereby enlarge the axial space gap between the opposite bases.

In the case of the central pole having the male and female snap fit elements arranged diametrically opposite to each other, the first and second holder halves are required to face each other with an angular phase gap of 180°, that is, 180° shift in orientation, to axially interlock each other, because both the holder halves have corresponding configurations. In this connection, with the holder halves having the above central poles and the auxiliary poles, the latter poles are required to have the male and female snap fit elements arranged diametrically opposite to each other. Further, in this case, if the central pole is designed to have upper male and lower female snap fit elements along a vertical center line passing through the axis of the holder half in a plan view thereof, a pair of left and right auxiliary poles may be arranged along a horizontal center line passing through the axis, each with upper male and lower female or upper female and lower male snap fit elements. The paired poles along the horizontal center line are neither required to be rotation-symmetrical with respect of the axis nor required to be symmetrical with respect to the vertical center line. This is because the left and right poles of the first holder half must be interconnected with the left and right poles of the second holder half, respectively, with the 180° shitf in orientation.

According to the present invention, each of the first and second holder halves may have at least a pair of upper and lower auxiliary hollow poles, both arranged symmetrically with respect to the horizontal center line in the plan view. Each of the paired upper and lower poles may have the male and female snap fit elements arranged diametrically opposite to each other. In this case, so long as the central main pole has the upper and lower elements arranged diametrically opposite to each other as described above, the male and female elements of the paired upper and lower poles must be arranged at the free wall ends of the poles, respectively, so as to be engageable with the female and male elements of a corresponding pair of the lower and upper poles in the counterpart holder half, respectively. This is because the upper pole of the paired auxiliary poles in the first holder half must be interlocked with the lower pole of a corresponding pair of auxiliary poles in the second holder half, when the first and second holder halves face each other with the angular phase gap of 180° to complete the holder. For example, the upper pole of a pair of auxiliary poles may have left male and right female elements, while the lower pole has left female and right male elements, respectively.

The upper male snap fit element embodied as the locking projection and the lower female snap fit element embodied as the locking window of each central pole are very effective in interlocking the first holder half with the second or counterpart holder half under a centrifugal force generated by rotation of the holder. This is because the opposite hooked heads of the locking projections are disposed from the interiors of the central poles into the associated locking windows radially outwardly or in the direction of the centrifugal force. Further, as in the above-mentioned central poles with the spindle fitted therein to back up the locking projections, the locking projections of a pair of the auxiliary poles would be backed up by a pair of the auxiliary shafts to thereby prevent the hooked heads from removing from the associated locking windows, if the auxiliary poles had the auxiliary shafts received therein.

The upper male element embodied as the locking projection and the lower female element embodied as the locking window of each of the paired auxiliary poles (left and right poles) arranged along the horizontal center line are not positively effective in interlocking the first holder half with the second holder half as much as those of the central pole, but are not affected in engagement at all by the centrifugal force. This is because the opposite hooked heads of the locking projections are disposed from the interiors of each auxiliary pole into the locking window in a tangential direction perpendicular to the direction of the centrifugal force. That is the engagement of the male and female elements under the centrifugal force in this case is effective to the same extent as that without any centrifugal force.

The left male and fight female elements of the upper pole and the left female and right male elements of the lower pole arranged symmetrically with the upper pole with respect to the horizontal center line along the vertical center line, as mentioned above, are not affected in engagement by the centrifugal force as well as the above case involving the horizontally arranged left and fight poles. Further, it should be noted that the locking projections with the hooked heads fitted in the associated locking windows in the paired auxiliary poles are backed up by the auxiliary shafts disposed in the holes of the auxiliary poles and fitted therein with the result that the hooked heads are prevented from removing radially inwardly from the windows, as in the case where the locking projections of the central poles are backed up by the spindle disposed in the holes of the central poles.

So long as the detent means of the poles in the holder, in combination, have a high resistance against breakage enough to have the opposite bases compact the stacked webs under a desired pressure, the first and second holder halves may be produced by an injection molding with a light plastic material. Of course, these holder halves may be also produced by a machining method with a metal, as needed, although they are relatively heavy.

The plastic holder halves are advantageous compared with the metal holder halves, in that: the holder halves are considerably lighter; their production cost is considerably reduced; and a precise size tolerance is ensured. These advantages are worthwhile to be highlighted in consideration of the fact that the holder according to the present invention can be inexpensive enough to be disposed with the worn web after prolonged use, although the present invention is not limited to a disposable holder but also provides a reusable holder.

To produce the plastic holder halves economically by the injection molding, it is desired that the first and second holder halves are geometrically and dimensionally equivalent to each other because the production can be effected using a single mold. However, to produce the holder halves using the most economical mold and injection-molding operation, the configuration of the holder half is limited to some designs. In light of the mold and injection-molding technology, one of the desired designs of the holder half is embodied such that the holder half has a base with holes, a central pole open to one of the base holes with upper and lower key projections provided with upper male and lower female snap fit elements, and a pair of symmetrically arranged left and right auxiliary poles open to the base holes, each provided with upper male and lower female snap fit elements. Preferably, the base has a pair of symmetrically arranged upper and lower holes along the vertical center line as positioning holes and also for a pair of auxiliary shafts to be connected to the spindle as a main shaft as needed. The auxiliary poles may be used for the auxiliary shafts in place of the positioning holes of the bases or used for additional auxiliary shafts, as needed.

To further reinforce the abrading disk tool at the snap detent means of the holder poles, an increase in the number of the poles is effective. Further, it may be advantageous to have each pair of the inter-locked auxiliary hollow poles, other than the pair provided with the auxiliary shaft extending therethrough, filled with a rod tightly-fitted in the paired poles or with some adhesive fillers to thereby form a substantially solid pole.

Figure 1B:
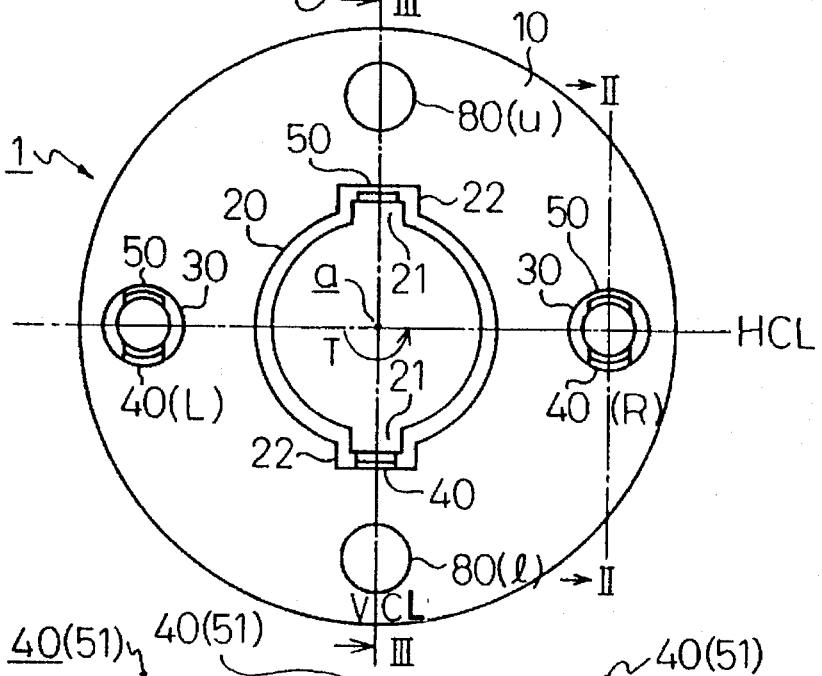
Figure 1A:
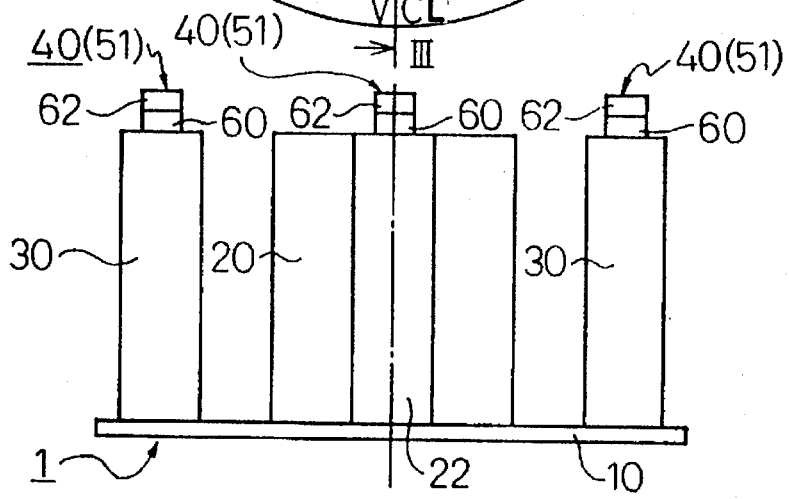
Figure 2:
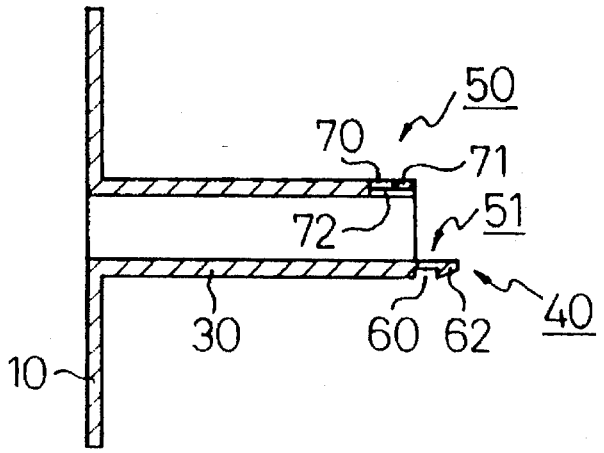
FIG. 2 is a cross-sectional view of an auxiliary pole with a disk base taken along line II—II in FIG. 1(B)
Figure 3:
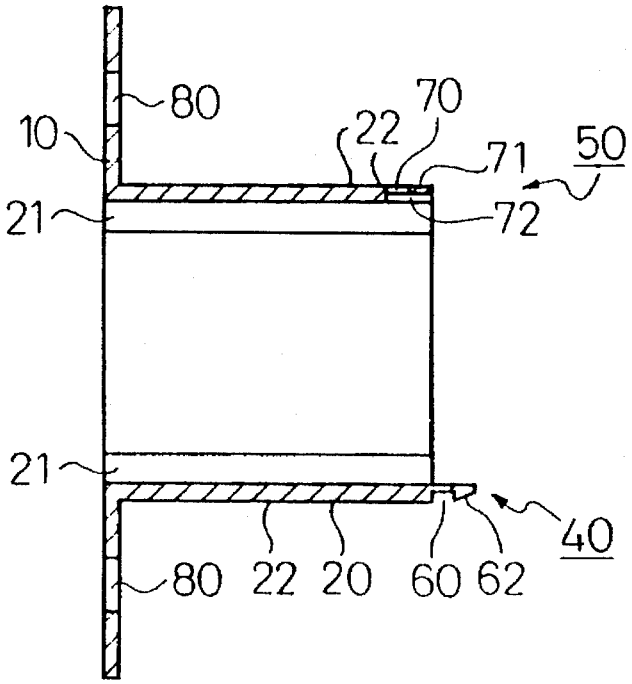
FIG. 3 is a cross-sectional view of a central or main pole with the base taken along line III—III in FIG. 1(B)
Figure 4:
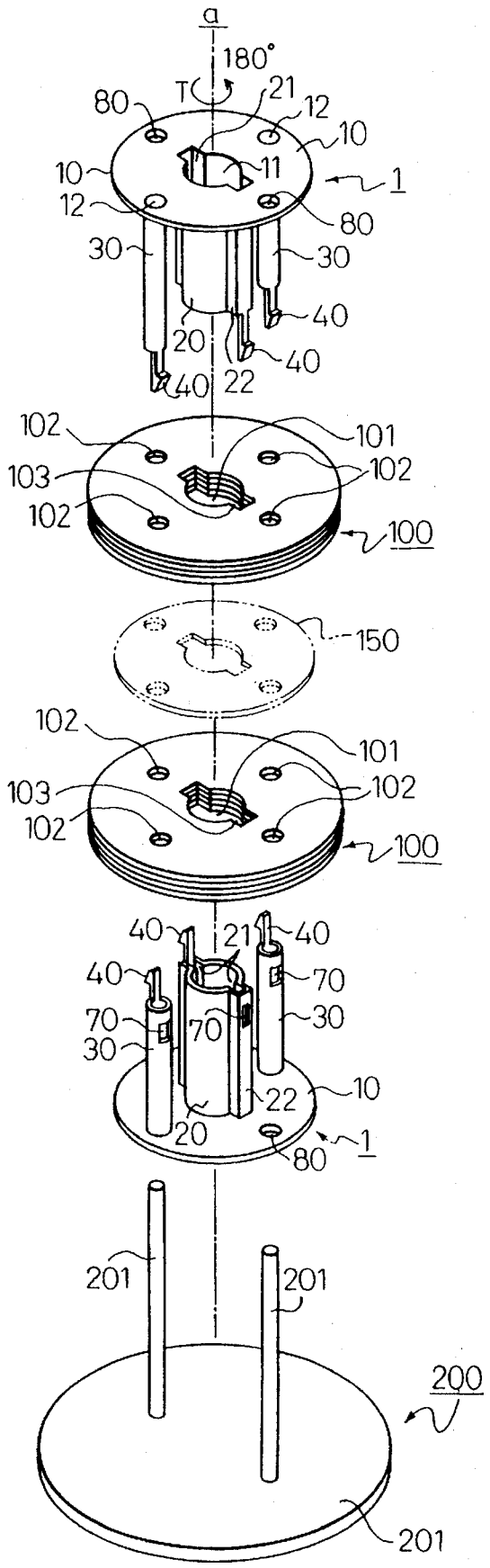
FIG. 4 is a perspective view separately showing the first and second holder halves; a multi-layer brush of webs to be stacked and compacted; and an operation table with positioning bars in a process of assembling an abrading brush tool using the holder according to the present invention.

FIGS. 1 to 5 show one embodied holder of the present invention, which is suitable for production by injection molding a plastic material. Referring to FIGS. 1 and 4, the holder consists of first and second holder halves 1 having a central axis (a), which are geometrically and dimensionally equivalent to each other, and thus can be injection-molded by the same mold. The holder half 1 has a disk base 10 with a pair of left (L) and right (R) upright poles 30 in a plan view of the base, having a smaller diameter as first and second primary auxiliary poles and a central upright pole 20 having a larger diameter as a main pole as shown in FIG. 1A and 1B. All of the poles 20, 30 have the same length. The main pole 20 is a coaxial extension from the base 10, and the main pole and the base in combination have a coaxial through-hole so that the main pole as a hollow pole forms a circumferential wall defining the most part of the through-hole, while the other part is formed as a central hole 11 in the base. The circumferential wall has a pair of upper and lower projections 22 defining a pair of key grooves 21 as key elements at the inner surface of the wall for a pair of corresponding key projections as reverse key elements of a rotation driving spindle to be mounted in the holder. The upper and lower key grooves 21 at the inner surface of the through-hole are formed to extend axially. Incidentally, if said key projection is identified as a key element, said key groove can be identified as a reverse key element.

Each auxiliary pole 30 and the base 10 in combination have a through-hole coaxial with the pole so that the pole forms as a hollow pole a circumferential wall defining the main part of the through-hole, while the other part is formed as a peripheral hole 12 of the base. The hollow poles may optionally be reinforced by any suitable means. The eccentrically arranged hollow poles may be tight-fitted to a reinforcing rod disposed in a through-hole formed in the hollow poles. The eccentrically arranged hollow poles may be filled with an adhesive reinforcing filler in a through-hole formed in the paired hollow poles.

The main hollow pole 20 (FIG. 3) and each auxiliary hollow pole 30 (FIG. 2) have male and female snap fit elements 40, 50 of snap detent means provided and arranged diametrically opposite to each other at the free ends of the circumferential pole walls, respectively. The main hollow pole 20 with the snap detent means (40, 50) is symmetrical in configuration with respect to a vertical or first center line (VCL) passing through the axis (a) of the disk base 10. Each auxiliary hollow pole 30 with the snap fit elements 40, 50 is symmetrical in configuration with respect to a vertical line passing through the axis of the pole, and is symmetrical to the other auxiliary pole with respect to the vertical center line (VCL).

As seen in FIG. 1(B), the disk base 10 has, in the plane view, a pair of upper (u) and lower (l) symmetrical positioning holes 80 diametrically opposite to each other along the vertical center line (VCL). The axes of the paired auxiliary poles 30 and the axes of the paired positioning holes 80 are arranged along a circle around the central main pole. There are predetermined radial space gaps between each auxiliary pole and the central pole and between each positioning pole and the central pole, and also with predetermined radial space gaps between each auxiliary pole and the periphery of the disk base and between each positioning hole and the base periphery, respectively. These radial space gaps are determined in connection with a size of a brush of abrasive non-woven fibrous webs 100 stacked one on another to be held by the holder between the disk bases thereof.

As seen in FIGS. 2 and 3, the male snap fit element 40 of each pole (20, 30) forms a locking projection 60 as a cantilever extending axially from the free wall end of the pole. The projection has a body 51 and a head 62 integrated therewith and hooked radially outwardly. The projection body 51 has a thickness less than that of the pole wall. The hooked head 62 is chamfered to taper toward the axially top end thereof.

The female snap fit element 50 of each pole (20, 30) forms a locking window or opening 70 formed in a portion 71 of the pole wall depressed radially outwardly from the inner wall surface at the free wall end. The depressed wall portion 71 defines at its inner surface a recess 72 extending axially outwardly and has a thickness reduced relative to that of the other wall portion so that the projection body thickness and the depressed wall portion thickness in combination amount to a value corresponding to that of the other wall portion. The recess 72 of each pole in each holder half is designed to be complementary to the associated projection body 61 of a corresponding pole in the counterpart holder half.

When the holder is assembled with the stacked webs 100 using the first and second holder halves 10, an operation disk table 200 having a pair of upright positioning bars 201 arranged so as to match with the positioning holes 80 is used, as shown in FIG. 4. Referring to FIG. 4, first, the first holder half 1 is put on the table 200 so as to have its inner surface face upwards with the positioning bars 201 of the table extending through the positioning holes 80 of the base.

Second, the disk webs 100 are stacked one on another on the inner surface of the base with the positioning bars 80 and the poles 20, 30 of the lower holder half extending through corresponding central and peripheral holes 101, 102 of a lower group of the piled webs. The holes 101,102 of each web are die-cut to have profiles similar to those of the main and auxiliary poles 20, 30 but preferably have somewhat smaller diameters than those of the poles, respectively.

Third, the second holder half 1 is faced coaxially on the first holder half on the table 200 so as to have its poles extend downwards with an angular phase gap of 180° or 180° shift in orientation between the upper and lower holder halves. That is, the second holder half is coaxially turned 180° relative to the first holder half on the table as indicated by an arrow T in FIG. 1 and 4, after or before the second holder half is capsized to face the first holder half. This positioning of the second holder half relative to the first holder half can be effected by disposing the positioning bars 201 extending outwards of the piled webs into the positioning holes 80 of the base in the second holder half such that one of the positioning bars 201 extending upwardly through the lower positioning hole (l) of the first holder half extends into the second positioning hole (u) of the second holder half, and similarly the other bar into the lower hole (l).

Fourth, the second holder half is pushed downwards by an operator or by aid of a pressing device as needed, until the poles of the second holder half abut against the counterpart poles of the first holder half. As a result, each pole (A) of the first holder half is interlocked with a counterpart pole (B) of the upper holder half by double engagements effected between the hooked head 62 of the locking projection 60 and the locking window 70 in the pole (A), and the locking window 70 and the hooked head 62 of the locking projection 60 in the counterpart pole (B), respectively. In this case, each projection body 51 of the pole (A) is bent radially inwards, while the chamfered top face of the hooked head 62 is entering into the interior of the pole (B) in contact with the pole end edge and then the following recess 72, and then is returned to the original position with the hooked head 62 being fitted in the locking window 70 of the counterpart pole (B), as shown in FIG. 5.

Figure 5:
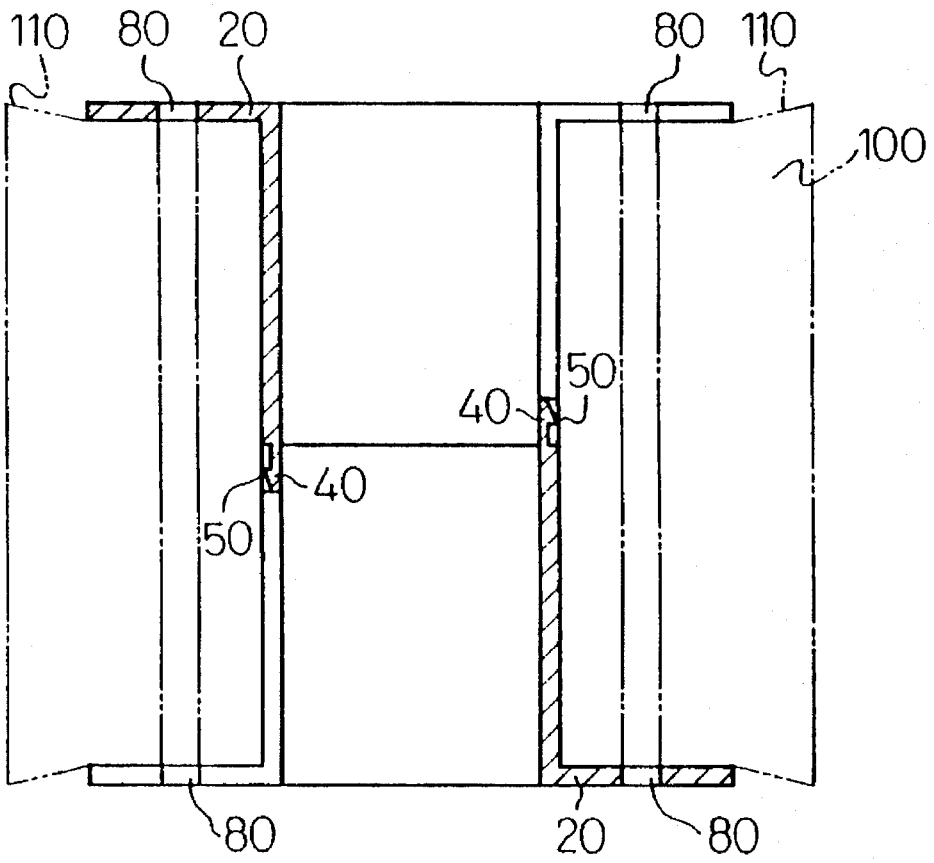
FIG. 5 is a cross-sectional view of the holder halves in an interlocked manner with the central poles of the first and second holder halves being engaged by male and female elements of snap detent means.

Referring to FIG. 5, the stacked webs 100 and the peripheral holes 102 corresponding to the positioning holes 80 are illustrated by dotted lines. The piled webs 100 are compacted by the holder between the bases 10 of the holder halves 1, provided that a circumferential outer portion 110 of the stacked webs 100 remains uncompacted as shown in FIG. 5. The outer web portion 110 is worn away during repeated abrading operations, and it can be applied for abrading without having the bases 10 obstruct the abrading operations.

When the brush of the compacted webs is applied against a product to be abraded, the product is apt to separate or split the stacked webs into at least two groups, but such split is not developed into the inner web portion overlapping the bases 10 due to the opposite bases 10 secured by the auxiliary poles 30. The stacked webs 100 are not rotated relative to each other due to the auxiliary poles 30 around the main pole 20 and the key projections 22 of the main pole engaging with corresponding key grooves 103 of the central holes 101 of the webs 100. In this regard, any backing plates 150 of a paper to be interposed into the stacked webs are no longer required. Of course, such backing plates 150 may be interposed in the webs, if desired, as seen in FIG. 4. In connection with this, it should be noted that the bases 10 are allowed to have the inner surfaces facing each other formed or treated so as to be a rough surface to exhibit a friction effect for the stacked webs, as needed.

Figure 6C:
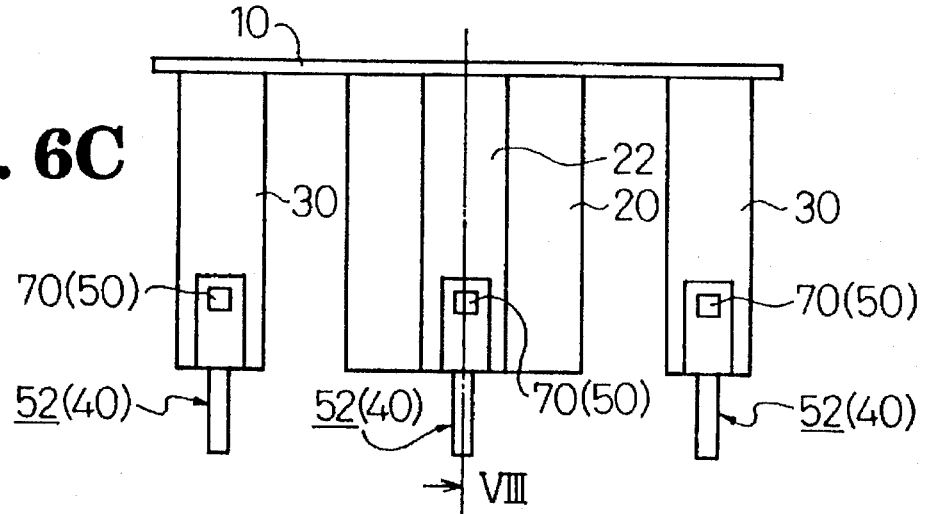
FIG. 6(C) is an elevational view of the holder half of FIG. 6(B) taken along plane 6(C)—6(C)
Figure 6B:
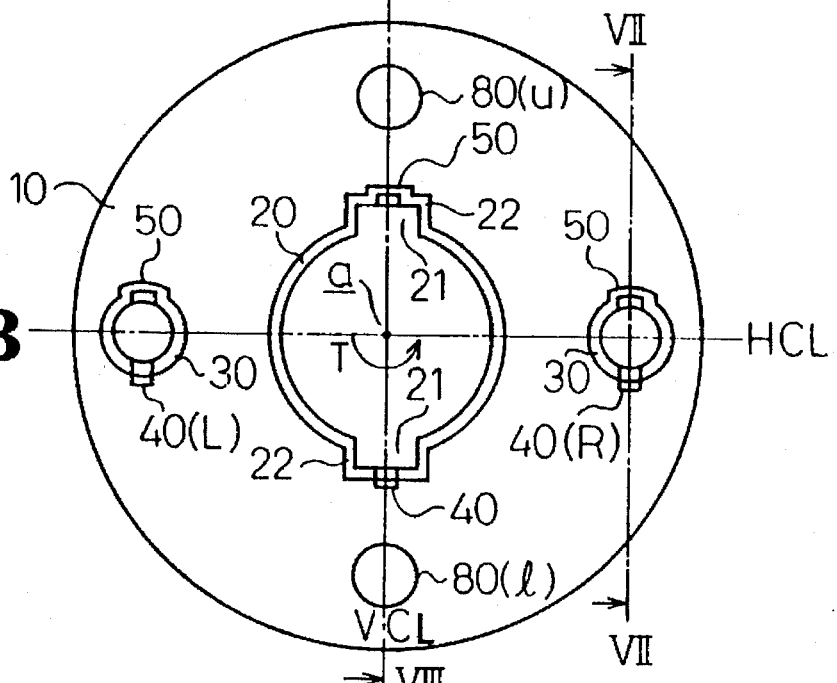
FIG. 6(B) is a plan view of the holder half of FIG. 6(A) taken along plane 6(B)—6(B)
Figure 6A:
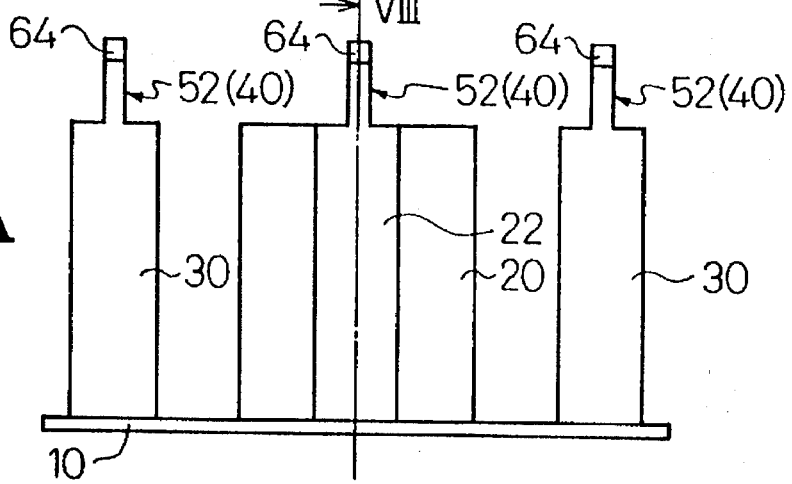
FIG. 6(A) is an elevational view of a holder half according to a second embodiment of the present invention.
Figure 7:
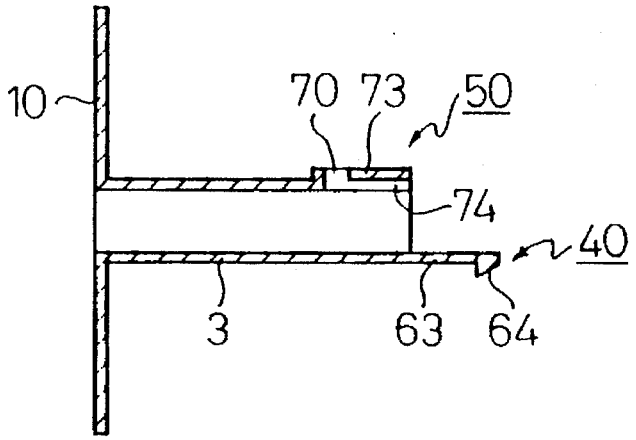
FIG. 7 is a cross-sectional view of an auxiliary pole with a disk base taken along line VII—VII in FIG. 6.
Figure 8:
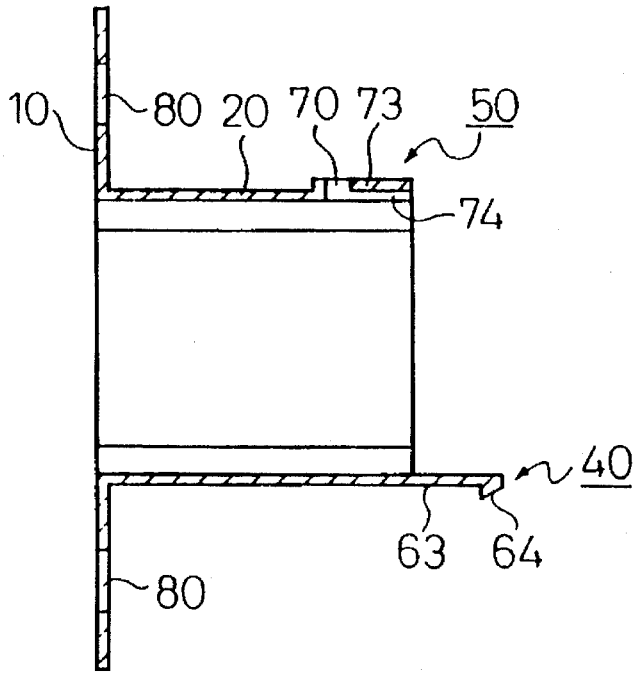
FIG. 8 is a cross-sectional view of a central or main pole with the base taken along line VIII—VIII in FIG. 6.

FIGS. 6 to 8 illustrate a second embodiment of a holder of the present invention. The second embodied holder is different from the first one, in male and female elements of corresponding snap detent means in each pole. Referring to FIGS. 6 to 8, most of the members or elements of the second embodied holder corresponding to those of the first embodied holder are denoted by the same reference numerals.

According to the second embodiment, the circumferential wall of each hollow pole (20, 30) is partially deformed to have a projection 73 extending radially outwards at the free wall end to thereby form at the inner wall surface a recess 74 extending axially outwards as seen in FIGS. 7–8. The radical projection 73 has a locking window 70 open to the recess 74. Each pole has a locking projection 52 axially extending from the free wall end. The axial locking projection 52 has a body 63 and a chamfered hooked head 64. The projection body 63 has the substantially the same thickness as that of the wall portion other than the deformed wall portion forming the radial projection 73. The recess 74 is designed to be complementary to the associated projection body 63 of a corresponding pole in the counterpart holder half. The male snap fit element formed by the axial locking projection 52 is engageable with the associated female snap fit element forming the locking window 70 of a corresponding pole in the counterpart holder half in the same manner as that in the first embodiment.

The snap detent means of the second embodiment is advantageously reinforced, compared with those of the first embodiment, since the projection body 63 and the deformed wall portion having the window 70 have the same thickness as that of the other wall portion; that is, they are thicker than those of the first example. Of course, first and second holder halves 1 to be combined to form the second embodied holder can be produced by the injection-molding, as well as those of the first embodied holder.

Figure 9:
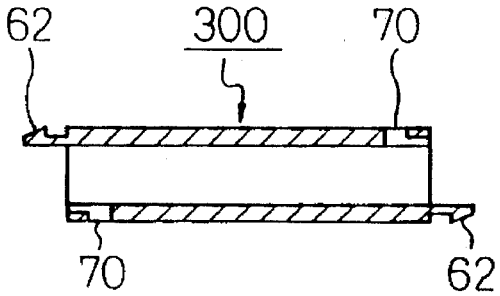
FIG. 9 is a cross-sectional view of a longitudinal spacer pole according to the present invention.

FIG. 9 shows a longitudinal spacer pole 300 according to the present invention to be used in combination with each auxiliary pole 30 of the first holder half and a corresponding auxiliary pole of the second holder half as shown in FIGS. 1 to 8 therebetween. According to the present invention, there is further provided another kind of a longitudinal spacer pole to be used in combination with the central poles 20 of the first and second holder halves. The two kinds of longitudinal spacer poles 300 are hollow poles having the same length and the same sectional profiles as those of the central pole and the auxiliary pole, respectively. Further, each longitudinal spacer pole 300 is provided at its opposite free wall ends with the same snap detent means as that of the associated central or auxiliary poles (20 or 30) to which it is connected therebetween.

In a case where the detent means consists of male and female snap fit elements 40, 50 as shown in FIG. 9 arranged diametrically opposite to each other, the male and female elements 40, 50 at one spacer pole end is positioned relative to those at the other spacer pole end with an angular phase gap of 180°, so that each pair of corresponding poles of the first and second holder halves are engageable with the associated longitudinal spacer pole at the opposite spacer ends. As a result, an axial space gap between the bases 10 of the first and second holder halves can be axially enlarged by the length of the spacers poles.

According to the present invention, the first and second embodied holder as shown in FIGS. 1 to 8 may be modified so that a pair of upper and lower hollow poles as secondary auxiliary poles, in the plan view, symmetrical with respect to a horizontal center line (HCL) passing through the axis (a) or a second center line perpendicular to the first center line are provided to extend axially from the base and open to the upper (u) and lower (l) positioning holes 80, respectively. The upper and lower pole are provided at their free ends, each with male and female snap fit elements, as well as the left (L) and fight (R) primary auxiliary poles 20. In this case, a pair of new positioning holes corresponding to the original positioning holes may be provided in the remaining surface portion of the base.

In this modification, the upper and lower poles, both are allowed to have lower male and upper female or upper male and lower female snap fit elements. Alternatively, the upper pole is allowed to have left male and fight female snap fit elements, while the lower pole has left female and right male elements or vice versa.

Further, according to the present invention, at least one pair of upper and lower poles as the secondary auxiliary poles, in the plan view, may be provided additionally or in place of the above-mentioned upper and lower poles arranged along the vertical center line (VCL). Each pair of the upper and lower auxiliary poles must be positioned symmetrically with respect to the horizontal center line (HCL), since any pair of the upper and lower poles must be inter-locked with the same pair of the lower and upper poles in the counterpart holder half. Therefore, male and female snap fit elements of each of the paired upper and lower poles must be arranged so that they are engageable with the female and male snap fit elements of the other one of the corresponding pair of the upper and lower poles in the counterpart holder half.

The above various modifications make it difficult to produce the holder half by the injection-molding, compared with the first and second embodied holder halves. However, such modified holder halves, of course, can be easily produced using a machining method with a metal material. In this case, it is preferable to arrange all of the auxiliary poles along a circle around the central pole with an equal space between neighboring auxiliary poles, or so as to be mutually concentric with the base axis.

In a case having such circumferentially arranged auxiliary poles, the central main pole may be omitted on the premise that the stacked webs have a central hole with key grooves, compatible with the spindle having the key projections.

Each pole may have snap detent means modified, for example, from that as shown in FIG. 2 or 7 such that in place of the single locking window (70) it has, with the pole wall recess (72; 74) being axially elongated, a plurality of spaced locking windows aligned axially with a space gap between neighboring windows at said elongated recess, while the body (60; 63) of the single locking projection (51; 52) is axially elongated to have a sufficient length to enable its hooked head (62; 64) to reach the axially innermost window along the elongated recess in a counterpart pole to be coupled. According to this multiple window case, the first and second holder halves can be coupled with an adjusted axial space gap between their opposite disk bases being selectively set to one of given discrete distances with a gap between neighboring distances equal to the above-mentioned axial gap between neighboring locking windows. This modified case is advantageous in that the space gap between the opposite disk bases of the holder can be adjusted to some limited extent without using any backing plate or any spacer pole which is mentioned before.

However, to ensure the hooked head of the elongated locking projection in each pole of the first and second holder halves engages with a selected locking window in a counterpart pole of the second and first halves, it is required to have a window or windows located closer to the free pole end than the selected window closed by such closure means as plugs or adhesive fillers, in advance, so that said closer windows are prevented from receiving the hooked head and thus the head is pushed past all of said closer windows, while the head is moving toward the selected window within the pole from the free end thereof.

Such closure means as above is eliminated in a further modified case, wherein each of the first and second holder halves is provided with only a central hollow pole as means for interlocking both the holder halves. Each central pole is provided with an elongated locking projection corresponding to that of the first modified case and with a plurality of axially spaced locking windows corresponding to those of the first modified case but arranged helically along the axis of the pole so as to be spaced circumferentially. Further, each central hollow pole has a plurality of sets (the number of the windows+1), each of a key groove and key projection corresponding to those (21, 22) shown in FIG. 1(B), arranged so as to be axially aligned with the circumferentially spaced locking windows and the elongated locking projection, respectively. When the first and second holder halves are coupled, the second holder half is capsized and axially turned a selected angle relative to the first holder half so that a selected locking window of each central pole is axially aligned with the elongated locking projection of a counterpart central pole to thereby allow the locked head of the locking projection to be pushed past a window or windows all located closer to the free pole end than the selected window toward the selected window. If the axially and circumferentially spaced windows consist of axially innermost, one or more intermediate and outermost windows, all of the windows may be positioned angularly in the range from preferably 135° to 225° relative to the locking projection with one of the intermediate windows, preferably a middle window, being located diametrically opposite to the locking projection. In this case, each disk web must be modified from that shown in FIG. 4 so that its central hole, in which both the central poles are adapted to extend, has first and second groups of key grooves formed for the key projections of both the central poles, which are located symmetrically with respect to the horizontal (or second) center line (HCL).

The holder of the present invention can be produced easily, using the injection-molding method with a plastic material or the machining method with a metal material, without using any adhesive, which, otherwise, would pollute the holder halves of the holder and the environment around the holder halves during the production. With the above advantages, the holder halves can be assembled with the stacked brush webs by only simple stacking and compacting operations to complete an abrading brush tool to be mounted on a rotation driving spindle in use.

Further, since such a provisional compacting operation as in the conventional method is not required, when compacting pressure is relatively small, any means for compacting the stacked webs other than an operator compacting the same for assembling the holder is not required.

Still further, in spite of the above meritorious facts, a high quality and performance of the abrading brush tool are ensured, as much as or more than those of the abrading brush tool according to the conventional third method involving the adhesive.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A holder for an abrading disk tool, the holder comprising:

first and second compatible holder halves;

wherein each of said first and second holder halves comprises a base having a central axis and includes a pole axially extending from the base;

wherein each of the poles includes a snap detent means, the detent means in the first holder half being engaged in a male-female relation with a corresponding detent means in the second holder half;

whereby the detent means axially inter-lock the first and second holder halves together with the bases facing one another and with the poles extending therebetween.

2. A holder according to claim 1, wherein each of the poles comprises a main hollow pole coaxial with the base axis and including main detent means, the base of each holder half having a central spindle-receiving hole open to the main hollow pole.

3. A holder according to claim 2, wherein each of the main hollow poles includes a respective pole key element axially extending along the main hollow pole, wherein each pole key element is adapted to engage at an external surface thereof with a complimentary key element in a brush to be held by the tool, and wherein each pole key element is adapted to engage at an internal surface thereof with a corresponding key element in a spindle to be fitted in the main hollow poles.

4. A holder according to claim 2, wherein each holder half further comprises an auxiliary pole arranged eccentrically from the base central axis and provided with auxiliary detent means.

5. A holder according to claim 2, further comprising a longitudinal spacer pole provided at opposite free ends thereof with first and second spacer detent means engaged with each main hollow pole of the first and second holder halves, respectively, wherein said first and second spacer detent means are engaged in a male-female relation with the detent means of the main hollow poles in the first and second holder halves, respectively.

6. A holder according to claim 1, wherein each snap detent means comprises at least one of male and female snap fit elements.

7. A holder according to claim 6, wherein each snap detent means comprises both male and female snap fit elements.

8. A holder according to claim 2, wherein each snap detent means includes male and female snap fit elements engaged with the female and male snap fit elements, respectively, of the other holder half, and wherein the male and female snap fit elements on each main hollow pole are arranged diametrically opposite to each other along a first center line passing through the base axis.

9. A holder according to claim 8, wherein each main hollow pole includes a brush keyway and wherein each respective base and main hollow pole, in combination, include a spindle keyway.

10. A holder according to claim 9, wherein the male and female detent elements of each main hollow pole are formed at a free wall end of a respective keyway.

11. A holder according to claim 8, wherein said first and second holder halves each further comprises first and second auxiliary poles arranged eccentrically from the base axis and diametrically opposite to each other with the main hollow pole therebetween along a second center line passing through the base axis perpendicular to the first center line;

wherein each of said first and second auxiliary poles extend axially from the base for the same length as that of the main hollow pole, each of the first and second auxiliary poles having a circumferential wall provided at a free wall end thereof with auxiliary male and female snap fit elements, wherein each of the auxiliary male and female snap fit elements of the first holder half are engaged with the auxiliary female and male snap fit elements of a corresponding auxiliary pole in the second holder half, respectively, the male and female snap fit elements of each auxiliary pole being arranged diametrically opposite to each other along a line parallel to the first center line.

12. A holder according to claim 4, wherein the auxiliary poles are mutually concentric with the base axis.

13. A holder according to claim 11, wherein the male detent element of each pole comprises a locking projection of a cantilever having a body axially extending from the free wall end and a head hooked radially outwardly, and the female snap fit element of each pole comprises a locking window formed in the circumferential wall at the free wall end, wherein the locking projection is resiliently bendable with the hooked head being chamfered to taper forwardly so as to allow the hooked head to enter under pressure into the associated hollow pole of the counterpart holder half from the free wall end thereof and then engage with the counterpart locking window thereof.

14. A holder according to claim 13, wherein the circumferential wall of each pole is partially depressed radially outwardly at the free wall end to form a depressed portion defining a recess extending axially outwardly at an inner wall surface of the circumferential wall, the depressed wall portion having the locking window formed therein and having a thickness reduced relative to that of the remainder of the circumferential wall, the projection body having a thickness reduced relative to that of the remainder of the circumferential wall so that the projection body and the depressed wall have a combined thickness substantially equal to that of the remainder of the circumferential wall.

15. A holder according to claim 13, wherein the circumferential wall of each pole is partially deformed to project radially outwardly at the free wall end to thereby form a recess extending axially outwardly, the projection body having substantially the same thickness as that of the circumferential wall portion other than the deformed wall portion, the projection body of the first holder half fitting within the recess of the second holder half.

16. A holder according to claim 8, wherein the first and second holder halves are geometrically and dimensionally identical to each other.

* * * * *